United States Patent [19]

Jackson

[11] 4,040,361

[45] Aug. 9, 1977

[54] RAILWAY LOCOMOTIVE TRUCK

[75] Inventor: Keith L. Jackson, Granite City, Ill.

[73] Assignee: General Steel Industries, Inc., St. Louis, Mo.

[21] Appl. No.: 683,923

[22] Filed: May 6, 1976

[51] Int. Cl.[2] ..... B61F 3/06; B61F 5/06; B61F 5/16; B61F 5/24

[52] U.S. Cl. ..... 105/136; 105/166; 105/196; 105/199 R

[58] Field of Search ..... 105/133, 136, 166, 188, 105/182 R, 195, 196, 199 R

[56] References Cited

U.S. PATENT DOCUMENTS

| | | | |
|---|---|---|---|
| 2,741,996 | 4/1956 | Kolesa | 105/196 |
| 3,387,569 | 6/1968 | Lich | 105/196 |
| 3,547,046 | 12/1970 | Lich | 105/182 R X |
| 3,693,553 | 9/1972 | Lich | 105/136 |
| 3,796,166 | 3/1974 | Wilmot | 105/199 R |

*Primary Examiner*—Robert J. Spar
*Assistant Examiner*—Howard Beltran
*Attorney, Agent, or Firm*—F. Travers Burgess

[57] ABSTRACT

A six-wheel railway motor truck for swivelly supporting a locomotive body is connected to the same for the effective transmission thereto of draft and braking forces at a level at or near that of the rail whereby the vertical moment arm through which traction forces might act to tip the truck frame and thereby cause load transference from axle to axle is minimized, with corresponding minimization of such load transference. The truck comprises a rigid frame resiliently supported on the three axles, a body support bolster comprising longitudinally spaced transversely extending end members and transversely spaced longitudinally extending side members defining an open central portion above the middle axle for providing unobstructed access to the middle axle motor and sufficient vertical clearance therefor while maintaining the bolster and overall truck height relatively low. One of the bolster transverse members is supported through a swivel center plate at its center on the longitudinal center line of the truck and the other bolster transverse member is supported near its ends on the sides of the truck frame to provide a stable three point support for the bolster and the locomotive body is carried on springs mounted respectively on the end portions of the respective bolster transverse members. For transmitting longitudinal forces from the truck to the supported body substantially at rail level, the bolster is connected to the vehicle body at each side by a pair of longitudinally upwardly and outwardly inclined links arranged so that their axial projections intersect at track level.

6 Claims, 4 Drawing Figures

RAILWAY LOCOMOTIVE TRUCK

BACKROUND OF THE INVENTION

1. Field of the Invention

The invention relates to railway rolling stock and consists particularly in a three-axle motor truck arranged for draft connection to a vehicle body such that load transference from axle to axle is minimized and so constructed that adequate vertical clearance is provided for the traction motors without substantially increasing the overall height of the truck.

2. Reference to Co-Pending Applications

The invention disclosed and claimed in this application is a modified and improved embodiment of the invention disclosed and claimed in my co-pending application Ser. No. 658,341, filed Feb. 17, 1976.

3. The Prior Art

The closest prior art to the present invention is a two-axle truck disclosed in Richard L. Lich U.S. Pat. No. 3,547,046 in which a bolster comprising a transversely extending single beam is swivelly mounted on a single center transom connecting the side members of the rigid truck frame, the opposite ends of the bolster having draft connections to the locomotive underframe comprising upwardly and outwardly longitudinally disposed links arranged such that their axial projections intersect at track level below the bolster. While this arrangement is adequate for a two-axle truck in which the oppositely directed motor to frame reaction connections are at its center transom, if a third intermediate axle were added to the truck below the bolster, the beam-like center transom and bolster would interfere with the middle axle motor and gear box placement or would require elevating the bolster and the body support springs to an undesirably high level.

SUMMARY OF THE INVENTION

A principle objective of the invention is to provide a six-wheel, three-axle railway locomotive truck of the type in which the bolster is swivelly supported on the truck frame at three points including a swivel center plate and a pair of transversely spaced sliding bearings spaced apart longitudinally of the truck from the swivel center plate and supports the locomotive body by upright springs aligned respectively transversely with the center plate and with the sliding bearings and is connected to the body at each side by outwardly and upwardly longitudinally inclined traction links, the axes of which converge at rail level beneath the bolster, in which the truck frame and co-operating portions of the bolster are so arranged to provide adequate clearance for the middle axle motor and gear box without any substantial increase in the overall height of the truck.

A more detailed objective of the invention is to provide a pair of spaced transoms fore and aft respectively of the middle axle to form transverse connections between the truck frame side members and to provide separate reaction connections for the middle and one end axle track motors and to provide a bolster similarly open at its center to leave sufficient vertical clearance adjacent the middle axle for the respective motor and gear box.

A further object is to provide an arrangement for transmitting body load from the bolster to the trunk frame at points spaced apart transversely and longitudinally of the truck frame and to accommodate swivel of the bolster about a vertical axis relative to the truck frame.

An additional objective is to substantially eliminate any load transference caused by the application of unbalanced motor torques to the truck frame by arranging all three traction motors with their reaction connections to the truck frame in the same direction with respect to their respective axles.

Figure 1:
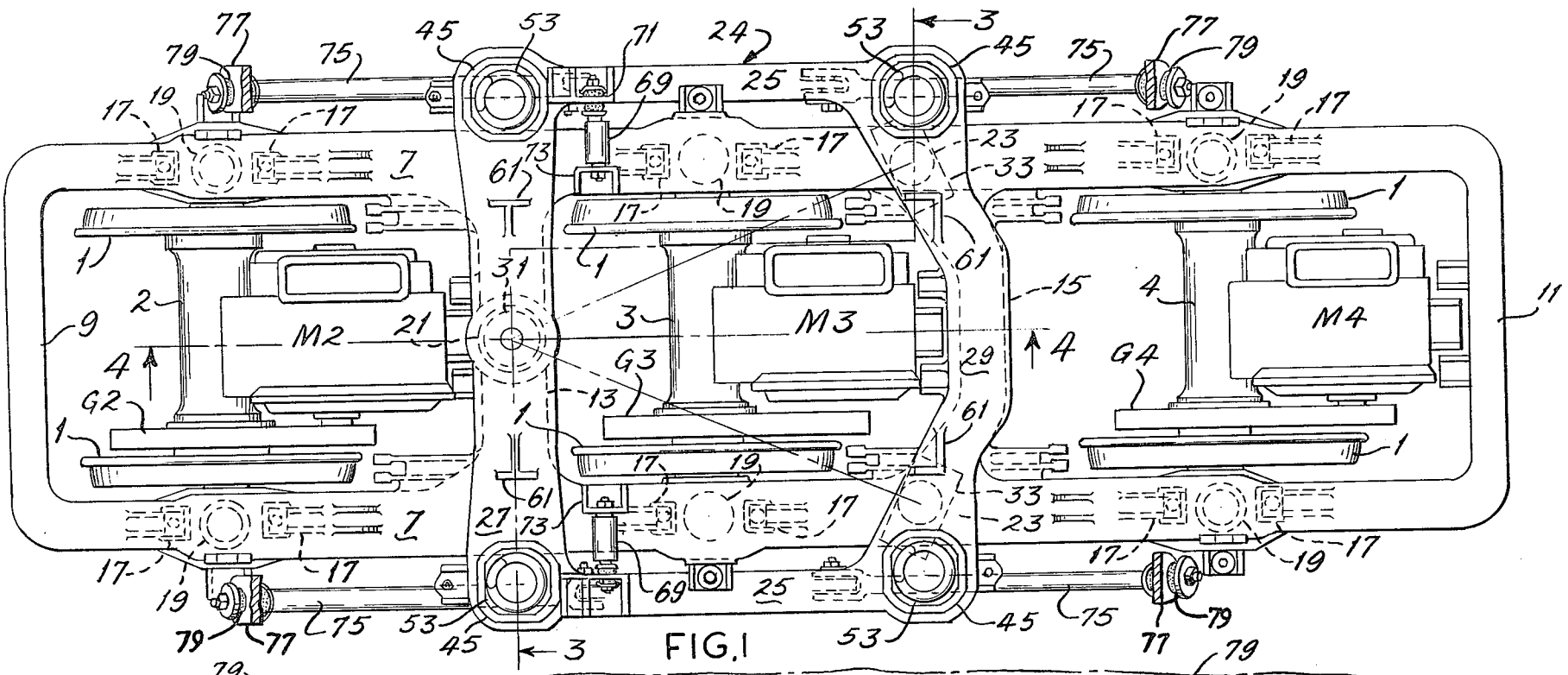
FIG. 1 is a plan view of a truck embodying the invention.
Figure 2:
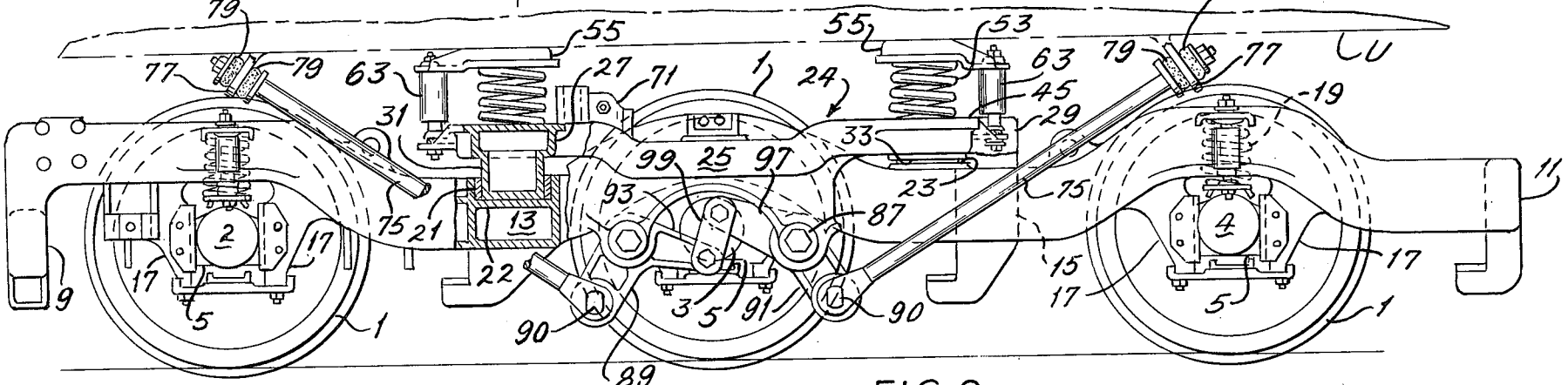
FIG. 2 is a side elevational view of the truck illustrated in FIG. 1 showing adjacent portions of the locomotive underframe.
Figure 3:
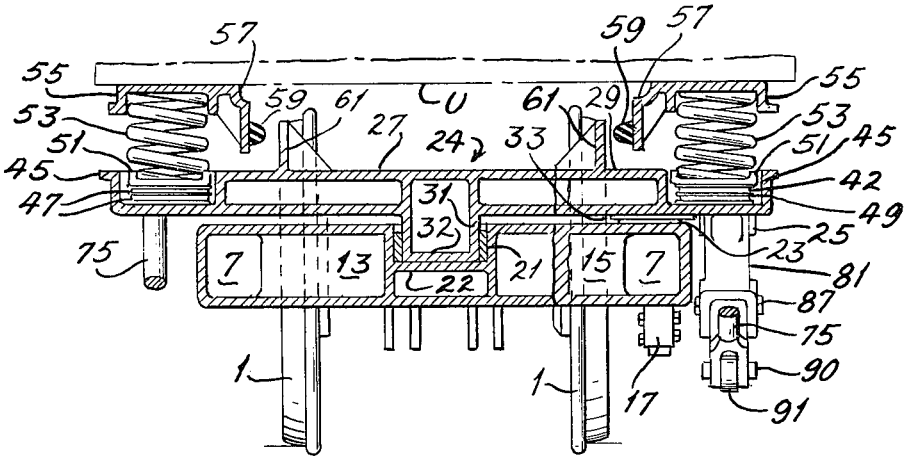
FIG. 3 is a transverse vertical sectional view taken along line 3—3 of FIG. 1.
Figure 4:
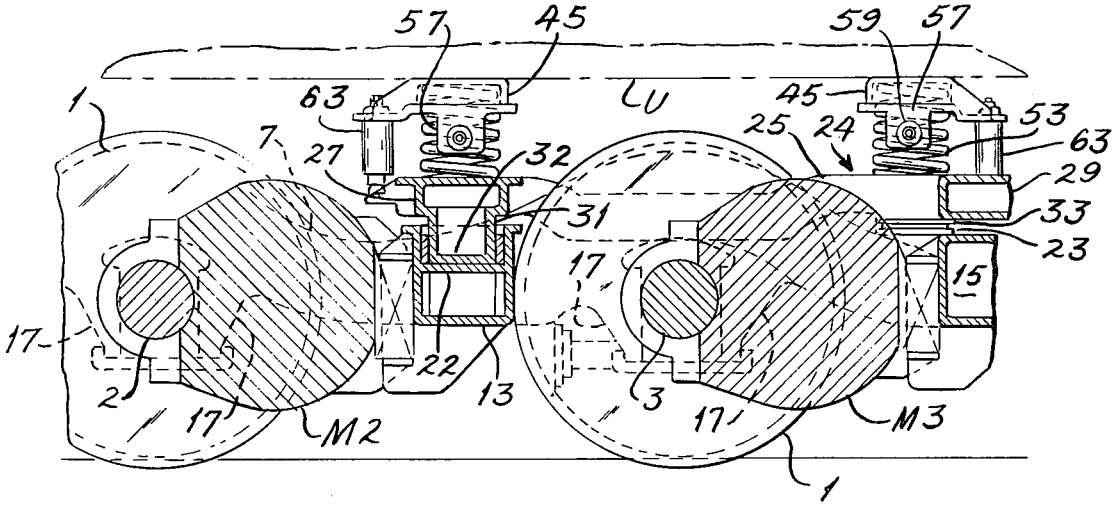
FIG. 4 is a longitudinal vertical sectional view taken along line 4—4 of FIG. 1.

The numeral 1 indicates railway flanged wheels mounted in gauged pairs of spaced axles 2, 3 and 4, axles 2 and 4 being end axles and axle 3 being a middle axle. At their ends, outboard of wheels 1, axles 2, 3 and 4 are rotatably received within journal boxes 5.

A rigid truck frame, preferably of one piece cast steel construction, comprises transversely spaced longitudinally extending side members 7 positioned transversely outboard of wheels 1 and rigidly connected to each other at their ends by transversely extending end transoms 9 and 11 and, between end axle 2 and middle axle 3 by intermediate transom 13, and between middle axle 3 and end axle 4 by intermediate transom 15.

Frame side members are vertically apertured adjacent journal boxes 5 to form pedestal jaws 17 and journal boxes 5 are vertically slidably received in the respective jaws 17 so as to maintain axles 2, 3 and 4 transverse of the truck frame. Coil spring units 19 are supported on top of journal boxes 5 and resiliently support frame side members 7 to cushion the frame from impacts imparted to the wheels by the track structure. For driving the truck, traction motors M2, M3 and M4 are journaled respectively on axles 2, 3 and 4 with their noses extending in the same direction lengthwise of the truck from their respective axles and having reaction connections respectively to intermediate transoms 13 and 15 and end transom 11.

Gear boxes G2, G3 and G4 drivingly connect the respective motors M2, M3 and M4 to axles 2, 3 and 4.

For supporting the car body underframe U on the truck frame and permitting vertical, transverse and swivel movements therebetween, intermediate transom 13 is formed at its center with an upwardly open cylindrical recess 21 having a horizontal bottom wall 22, and a pair of upwardly facing bearing surfaces 23 are formed on side members 7 adjacent the intersections therewith of intermediate transom 15, the portions of side members 7 between pairs of pedestal jaws 17 being depressed to minimize the height of the tops of transoms 13 and 15 and consequently of center plate recess 21 and bearing surfaces 23 above the rail.

A bolster, generally indicated at 24, has longitudinally extending side members 25 positioned transversely outboard of truck frame side members 7 and transversely extending end members 27 and 29 spaced apart longitudinally of the truck and, respectively, overlying intermediate transoms 13 and 15. Bolster end members 27 and 29 are formed respectively with a central downwardly facing cylindrical boss 31 and transversely spaced downwardly facing sliding bearings 33, cylindrical boss 31 being pivotally received in recess 21 in transom 13 with its bottom wall 32 seated on bottom wall 22 of recess 31, and with downwardly facing sliding bearings 33 slidably seated on upwardly facing bearings 23. It will be seen from the foregoing and by reference to the drawings that the swivel center plate 21, 22, 31, 32 and transversely spaced sliding bearings 23, 33 define a stable three-point support for bolster 25, 27, 29 on the truck frame permitting the space between bolster end members 27 and 29 and bolster side members 25 to be open, thus providing adequate vertical clearance for the middle axle wheels, for middle axle motor M3 and associated gear box G3 while permitting the overall height of the bolster to be minimal.

Adjacent the intersections of bolster end members 27 and 29 respectively and bolster side members 25, the latter are formed with upwardly open spring pockets 45. It will be noted that the spring pockets 45 on bolster end member 27 are in transverse alignment with center plate device 21, 22, 31, 32 and that spring pockets 45 on bolster 29 are in transverse alignment with downwardly facing bearings 23 on bolster end member 29 so that bolster end member 27 functions as a beam supported at its center and loaded at its ends at spring pockets 45 and bolster end member 29 functions as a beam supported at bearings 23, 33 inwardly of its ends and loaded at its ends at spring pockets 45, the principal function of bolster side members 25 being to position bolster end members 27, 29 with respect to each other. To permit transverse movement of vehicle underframe U relative to the truck, a sandwich device comprising a pair of horizontal elastomeric pads 47 bonded by and interleaved with metal plates 49, is seated in each pocket 45 and supports an upwardly open spring seat 51. Each spring seat 51 in turn mounts an upright metallic coil spring 53, which directly supports spring caps 55 which are secured to the bottom of underframe U.

Underframe U is thus capable of vertical movement relative to bolster 25, 27 and 29 through vertical deflection of springs 53 and of lateral movement relative to the bolster through shear deflection in springs 53 and elastomeric pads 47. For limiting lateral movement of the underframe with respect to bolster 25, 27, 29 spring caps 55 are formed with inwardly facing depending lateral stop brackets 57 on which are mounted elastomeric bumpers 59 and bolster end members 29 and 31 are each provided with upstanding lateral stop abutments 61 normally spaced inwardly from elastomeric bumpers 59 and adapted for resilient engagement therewith as maximum transverse movement of the underframe with respect to the truck is reached.

To dampen vertical movements of the underframe U with respect to bolster 25, 27, 29, upright snubbers 63 adjacent bolster spring seat pockets 45 are connected at their lower ends to brackets 65 on the bolster and 67 on spring caps 55.

For transmitting draft forces from the truck at the lowest possible level, preferably rail level, to underframe U and thereby minimize load transference between the axles, bolster side members 25 are connected to underframe U by outwardly and upwardly directed links 75, the axial projections of which converge at rail level so that the resultant of the forces transmitted axially by both anchors at each side is at rail level.

The connection of links 75 to underframe U includes brackets 77 on underframe U and resilient pads 79 to accommodate angling of the anchors with respect to the underframe brackets necessitated by vertical and lateral movements of the underframe relative to the truck bolster.

In order to avoid interference by links 75 with the operation of body support springs 53, bolster side members are formed with transversely spaced depending webs 81 defining between them downwardly open brackets and the connections of the links 75 to the bolster side members 25 each comprises a device consisting of a pair of bell cranks 93, 97 fulcrumed on transverse axes defined by pivot pins 85 and 87 on webs 81 and 83 and having substantially upright arms 89 and 91 pivotally connected at their lower ends respectively at 90 to links 75. Pivotal connections 90 of links 75 to bell crank arms 89 and 91 respectively are constructed to permit universal pivotal movements of links 75 with respect to the respective bell crank arms. The bell cranks have substantially horizontal arms 93 and 97 respectively extending longitudinally of the truck toward each other with their terminals vertically disposed with respect to each other and connected by a short vertical link 99.

It will be evident that as the car body moves vertically and laterally with respect to bolster 45 through deflection of springs 53 and shear in elastomeric pads 47, that the bell cranks are pivoted about their respective fulcrums equal distances in opposite rotational direction and will accommodate such movements while maintaining traction links 75 in longitudinal force-transmitting relation between the bolster and underframe U, the effective level of such force-transmission being at the level of convergence of the projections of links 75, i.e., at rail level.

Operation of the truck is as follows: As motors M2, M3 and M4 drive axles 2, 3 and 4 respectively through gear boxes G2, G3 and G4, since their reaction connections to intermediate transoms 13, 15 and end transom 11, respectively, are in the same direction from the respective axles, the motor reactions will tend to raise or lower the entire truck frame simultaneously depending upon direction of operation and will thus produce no axle-to-axle load transference.

Because of the convergence of traction links 75 substantially at rail level, the effective level of longitudinal force transmission from the truck to underframe U will be at the same level, thus eliminating any vertical moment arm about which traction forces might tend to tip the truck frame and thereby transfer load from axle to axle. When body support springs 53 are compressed, left hand traction link 75 causes left hand bell crank 89, 93 to pivot counterclockwise about its fulcrum 85 and right hand traction link 75 causes right hand bell crank 91, 97 to pivot clockwise about its fulcrum 87, both bell cranks pivoting in unison in opposite rotational directions by virtue of their connection to each other by link 99. Thus, irrespective of the extent to which springs 53 are compressed, links 75 are constantly in longitudinal force-transmitting relation between the truck bolster and underframe U. During lateral movements of underframe U with respect to the truck bolster as are permitted by shear deflection in elastomeric pads 47, irrespective of the transverse direction, the bell cranks 89, 93 and 91, 97 will be pivoted respectively in clockwise and counterclockwise directions but will constantly maintain traction links 75 in longitudinal force-transmitting relation between the truck bolster and underframe U.

The details of the construction may be varied substantially without departing from the spirit of the invention and the exclusive use of those modifications as come within the scope of the claims is contemplated.

I claim:

1. In a railway locomotive truck, three wheeled axles spaced apart longitudinally of the truck including first and second end axles and a middle axle therebetween, a rigid truck frame resiliently supported from said axles, said truck frame comprising longitudinally extending side members and first and second transversely extending transom members connecting said side members, respectively, intermediate said first end and said middle and said second end axles, traction motors respectively drivingly connected to each of said axles and having reaction connections to the frame, a bolster comprising longitudinally extending side members and transversely extending first and second end members connecting said side members, said side members being disposed transversely outboard of said truck frame side members and said bolster end members, respectively, overlying at least in part the respective intermediate truck frame transoms, said bolster and said truck frame being substantially free of structural elements in the region defined by said bolster end members and said truck frame side members, whereby said bolster end members and the portions of said frame side members provide an opening substantially commensurate with the space defined by said intermediate transom members and said frame side members, said first intermediate truck frame transom and said first bolster end member having cooperating vertical axis swivel bearings at their centers in vertical load supporting relation with each other and the truck frame and said second bolster end member having transversely spaced opposed horizontal sliding bearings in vertical load supporting relation with each other for providing a stable three-point support of said bolster on said truck frame, upright springs carried on the end portions of said bolster end members for supporting a locomotive body on the truck, and a pair of longitudinally upwardly and outwardly inclined links connected at their lower ends to said bolster side members and arranged for connection at their upper ends to the locomotive body, such that their axial projections intersect substantially at rail level whereby to transmit tractive forces from the truck to the locomotive body substantially at rail level, the upright springs on said first bolster end member being in substantial alignment transversely of the truck with the vertical axis of said swivel bearing and the upright springs on said other bolster end member being in substantial alignment transversely of the truck with said sliding bearings, whereby each of said bolster end members constitutes a beam loaded adjacent its ends and supported intermediate its ends on said truck frame, and said bolster side members constitute vertically unloaded spacers and ties between said bolster end members.

2. A railway motor truck according to claim 1, wherein the connection of said links to said bolster comprises a pair of bell cranks fulcrummed to said bolster side members on transverse axes spaced apart longitudinally of the truck and having substantially horizontal arms extending toward each other and connected to each other by a substantially vertical link, and other arms extending substantially normal to the axes of the respective inclined links and being pivotally connected thereto.

3. A railway motor truck according to claim 1, wherein the reaction connections of said motors to the truck frame are all in the same direction from the respective axles to which the motors are drivingly connected.

4. A railway motor truck according to claim 1, wherein said co-operating vertical axis swivel bearings comprise a female cylindrical member on said first truck frame transom and a male cylindrical member on said first bolster end member.

5. A railway locomotive truck according to claim 1, wherein the reaction connections to the truck frame of the traction motors drivingly connected to said first end axle and to said middle axle are respectively by means of said first and second intermediate transoms, the traction motor connected to said middle axle being positioned between the middle axle and said second intermediate transom, and the central portion of said second bolster end member and said second intermediate transom are similarly offset longitudinally of the truck away from the middle axle and toward said second end axle.

6. A railway locomotive truck according to claim 5, wherein as end transverse transom connects said frame side members longitudinally outboard from said second end axle and the traction motor connected to said second end axle has its reaction connection to said end transom.

* * * * *